US010173388B2

(12) United States Patent
Awano et al.

(10) Patent No.: US 10,173,388 B2
(45) Date of Patent: Jan. 8, 2019

(54) RECORDING-MEDIUM BINDING DEVICE

(71) Applicant: FUJI XEROX CO., LTD., Tokyo (JP)

(72) Inventors: Hiroaki Awano, Kanagawa (JP); Takuya Makita, Kanagawa (JP); Katsumi Harada, Kanagawa (JP); Kojiro Tsutsumi, Kanagawa (JP); Toshiyasu Yukawa, Kanagawa (JP); Takashi Ogino, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/698,814

(22) Filed: Sep. 8, 2017

(65) Prior Publication Data

US 2018/0272786 A1 Sep. 27, 2018

(30) Foreign Application Priority Data

Mar. 22, 2017 (JP) ..... 2017-056073

(51) Int. Cl.

| | |
|---|---|
| ***B31F 5/02*** | (2006.01) |
| ***B42C 1/12*** | (2006.01) |
| ***B65H 37/04*** | (2006.01) |
| ***B42B 5/00*** | (2006.01) |

(Continued)

(52) U.S. Cl.

CPC ..... *B31F 5/02* (2013.01); *B42B 5/00* (2013.01); *B42C 1/12* (2013.01); *B65H 37/04* (2013.01); *G03G 15/6544* (2013.01); *B31F 2201/0712* (2013.01); *B42F 3/006* (2013.01); *B65H 2301/43828* (2013.01); *B65H 2301/51616* (2013.01); *B65H 2801/24* (2013.01); *G03G 2215/00848* (2013.01); *G03G 2215/00852* (2013.01)

(58) Field of Classification Search

CPC ..... B31F 5/00; B31F 5/02; B31F 2201/0712; B42F 3/006; B65H 2801/24; B65H 2301/43828; B65H 2301/51616; G03G 15/6544; G03G 2215/00852; G03G 2215/00848

USPC ..... 270/58.07, 58.08

See application file for complete search history.

(56) References Cited

U.S. PATENT DOCUMENTS

| | | | | |
|---|---|---|---|---|
| 8,983,362 | B2 * | 3/2015 | Nakamura | B65H 37/04 270/58.08 |
| 2016/0107409 | A1 * | 4/2016 | Kubo | B31F 1/07 412/33 |
| 2017/0174465 | A1 * | 6/2017 | Morinaga | B31F 5/02 |

(Continued)

FOREIGN PATENT DOCUMENTS

JP 2016-79000 A 5/2016

*Primary Examiner* — Leslie A Nicholson, III

(74) *Attorney, Agent, or Firm* — Sughrue Mion, PLLC

(57) ABSTRACT

A recording-medium binding device includes a first tooth row including plural teeth and a second tooth row including plural teeth. The first and second tooth rows include a central region and end regions. The plural teeth of each of the first and second tooth rows include at least one tooth disposed in the central region and at least one tooth dispose in each of the end regions. In a process of pinching the recording medium batch, the at least one tooth of the first tooth row in the end region and the at least one tooth of the second tooth row in the end region pinch the recording medium batch earlier than the at least one tooth of the first tooth row in the central region and the at least one tooth of the second tooth row in the central region.

5 Claims, 3 Drawing Sheets

(51) Int. Cl.
*G03G 15/00* (2006.01)
*B42F 3/00* (2006.01)

(56) References Cited

U.S. PATENT DOCUMENTS

| | | | | |
|---|---|---|---|---|
| 2017/0217239 | A1* | 8/2017 | Suzuki | B42C 1/12 |
| 2017/0282482 | A1* | 10/2017 | Awano | B31F 5/02 |
| 2017/0283206 | A1* | 10/2017 | Makita | B65H 37/04 |
| 2017/0283207 | A1* | 10/2017 | Makita | B65H 37/04 |

* cited by examiner

RECORDING-MEDIUM BINDING DEVICE

CROSS-REFERENCE TO RELATED APPLICATIONS

This application is based on and claims priority under 35 USC 119 from Japanese Patent Application No. 2017-056073 filed Mar. 22, 2017.

BACKGROUND

(i) Technical Field

The present invention relates to a recording-medium binding device.

(ii) Related Art

There exists a known recording-medium binding device. With this recording-medium binding device, a recording medium batch, that is, plural recording media that are stacked one on top of another, are pinched so as to be subjected to pressure by tooth rows paired with and engaged with each other. As a result, the recording media are deformed into a wave shape and combined with one another. While being deformed into a wave shape, the plural recording media pinched by the tooth rows are stretched and subjected to the pressure so as to be combined with one another.

SUMMARY

According to an aspect of the present invention, a recording-medium binding device includes a first tooth row and a second tooth row. The first tooth row includes plural teeth arranged in a tooth arrangement direction. The second tooth row includes plural teeth arranged in the tooth arrangement direction, is to be engaged with the first tooth row, and cooperates with the first tooth row to pinch a recording medium batch so as to bind recording media.

The first tooth row and the second tooth row include a central region having sides and end regions disposed beside the respective sides of the central region in the tooth arrangement direction. The plural teeth of the first tooth row include at least one tooth disposed in the central region and at least one tooth dispose in each of the end regions. The plural teeth of the second tooth row include at least one tooth disposed in the central region and at least one tooth disposed in the end region. In a process of pinching the recording medium batch, the at least one tooth of the first tooth row in the end region and the at least one tooth of the second tooth row in the end region pinch the recording medium batch earlier than the at least one tooth of the first tooth row in the central region and the at least one tooth of the second tooth row in the central region.

BRIEF DESCRIPTION OF THE DRAWINGS

Exemplary embodiment of the present invention will be described in detail based on the following figures, wherein.

DETAILED DESCRIPTION

Figure 1:
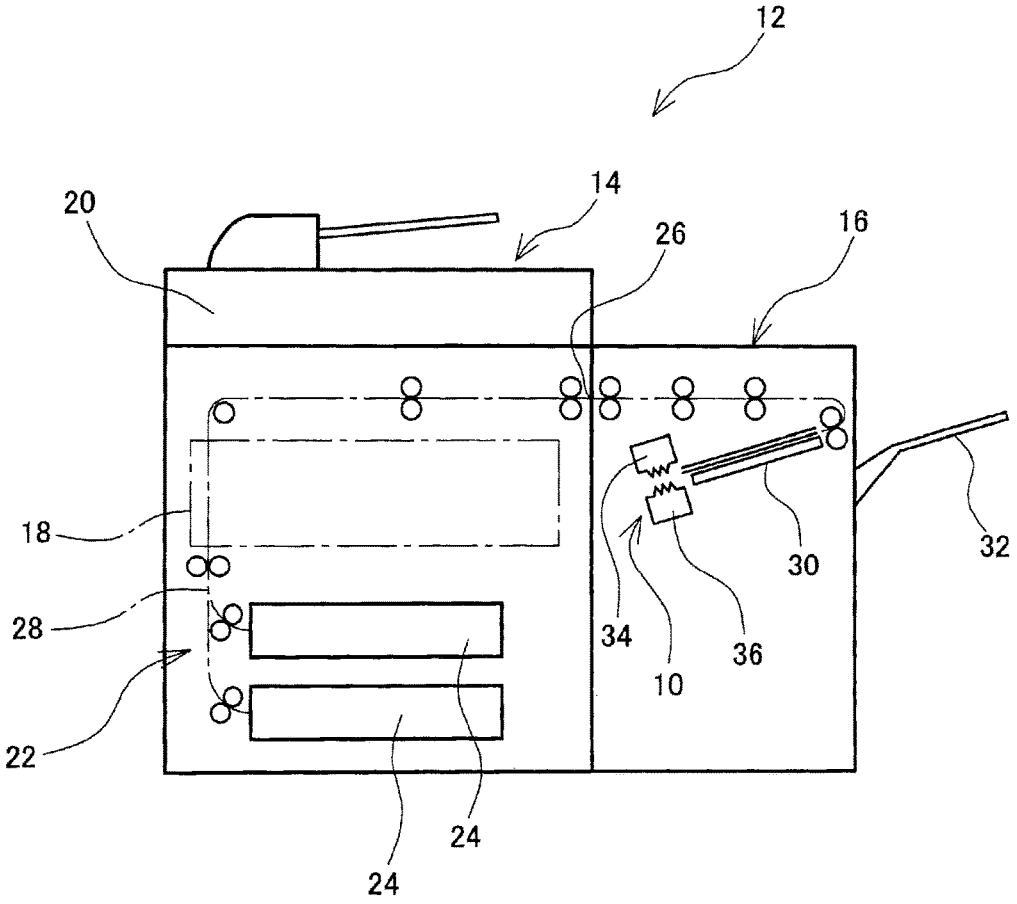
FIG. 1 is a schematic view of the structure of an image forming system.

An exemplary embodiment of the present invention will be described below with reference to the drawings. FIG. 1 is a schematic view of the structure of an image forming system 12 that includes a recording-medium binding device 10 according to the present exemplary embodiment. The image forming system 12 includes an image forming apparatus 14 and a recording-medium post processing apparatus 16. The image forming apparatus 14 has functions such as, for example, electrophotographic printing and copying functions. The recording-medium post processing apparatus 16 performs post processes such as, for example, punching and binding on recording media on which images have been formed by the image forming apparatus 14. The recording-medium binding device 10 according to the present exemplary embodiment is mountable in the recording-medium post processing apparatus 16.

The image forming apparatus 14 includes an image forming section 18 that forms toner images in accordance with obtained document information. The document information may be obtained by reading a document with a document reader 20 included in the image forming apparatus 14 or obtained from an external device. The image forming apparatus 14 further includes a recording-medium feeding mechanism 22. The recording media to be fed are sheet-shaped recording media having been cut into rectangular shapes made of, for example, paper. The recording-medium feeding mechanism 22 includes feed trays 24 and a transport path 28. The feed trays 24 hold the recording media stacked thereon. The transport path 28 allows the recording media to be fed therethrough from the feed trays 24 to an output opening 26. The toner images having been formed by the image forming section 18 are received by and fixed onto the recording media while the recording media are transported through the transport path 28. The recording media having been output through the output opening 26 are received by the recording-medium post processing apparatus 16.

The recording media received by the recording-medium post processing apparatus 16 are accumulated on an accumulation tray 30 according to need so as to form a batch of recording media. In the case where the accumulation is not required, the recording media are fed to an output tray 32. When a predetermined number of recording media are accumulated on the accumulation tray 30, the recording media are bound by the recording-medium binding device 10. The recording-medium binding device 10 includes two tooth forms 34 and 36 that are paired with each other. Each of the tooth forms 34 and 36 includes plural teeth arranged thereon. For convenience of distinguishing between two tooth forms, the tooth forms illustrated on the upper and lower sides of FIG. 1 are respectively referred to as the upper tooth form 34 and the lower tooth form 36. It is sufficient that two tooth forms 34 and 36 face each other with the recording media to be bound pinched therebetween. For example, the tooth forms 34 and 36 may be respectively arranged on the left and right sides, or the upper tooth form 34 and the lower tooth form 36 may be respectively disposed on the lower and upper sides.

One or both of the upper tooth form 34 and the lower tooth form 36 are advanced toward and retracted from the other or each other by a drive mechanism. When one or both of the upper tooth row and the lower tooth row are advanced, tooth rows of both the tooth forms are engaged with each other. When the tooth rows are engaged with each other, the recording media pinched therebetween are deformed into a wave shape, pressed against one another, combined with one another, and bound to one another. The batch of recording media having been bound is fed to the output tray 32.

Figure 2:
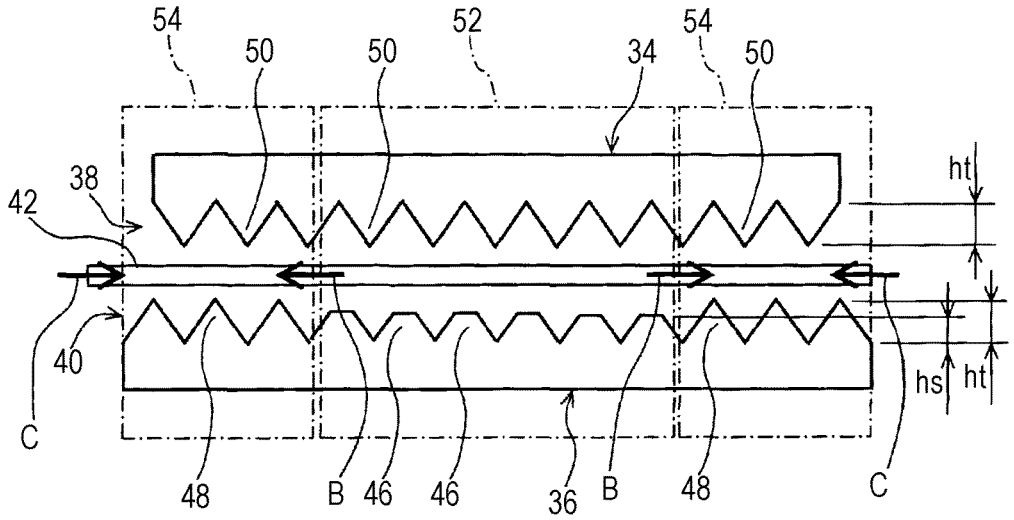
FIG. 2 illustrates an example of tooth rows of a recording-medium binding device.

FIG. 2 illustrates the upper tooth form 34 and the lower tooth form 36. The teeth are arranged in the lateral direction of FIG. 2, thereby the tooth rows are formed. The tooth row of the upper tooth form 34 is referred to as an upper tooth row 38, and the tooth row of the lower tooth form 36 is referred to as a lower tooth row 40. A direction in which the teeth are arranged, that is the lateral direction is referred to as a "tooth arrangement direction". Furthermore, a direction of the height of the teeth, that is, the vertical direction of FIG. 2 is referred to as a "tooth height direction", and a direction perpendicular to the tooth arrangement direction and the tooth height direction is referred to as a "tooth width direction" in the following description.

Figure 3:
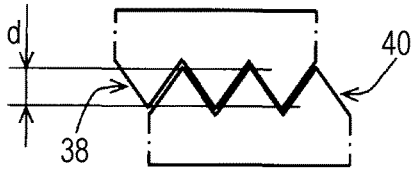
FIG. 3 illustrates an engagement overlapping amount.

Referring to FIG. 2, the upper tooth form 34 and the lower tooth form 36 are separated from each other, being in an open state. The upper tooth form 34 and the lower tooth form 36 in the open state move while facing a recording medium batch 42. When the upper tooth form 34 and the lower tooth form 36 are moved to close the recording-medium binding device 10, the recording medium batch 42 is pinched between the upper tooth row 38 and the lower tooth row 40 and bound. In FIG. 2, part of the recording medium batch 42 is illustrated. When the recording medium batch 42 is pinched between the upper tooth row 38 and the lower tooth row 40, the stacked recording media included in the recording medium batch 42 are, while being stretched in the tooth arrangement direction, deformed into a wave shape and further pressed so as to be combined with one another. Deformation of the recording media varies in accordance with the amount by which the teeth included in the upper tooth row 38 and the teeth included in the lower tooth row 40 are engaged with one another. This amount of mutual engagement of the teeth when the tooth rows 38 and 40 are engaged with each other without pinching the recording medium batch 42 therebetween is defined as an overlapping amount of the teeth included in the tooth rows 38 and 40. As illustrated in FIG. 3, when the tooth rows 38 and 40 are engaged with each other without pinching the recording media therebetween, the distance between tooth tops of the teeth included in the tooth rows 38 and 40 in the vertical direction is defined as an "engagement overlapping amount d".

The recording medium batch 42 is formed by stacking multiple recording media. The thickness of the recording medium batch 42 is small when the number of stacked recording media is small and large when the number of stacked recording media is large. There is an appropriate value of the engagement overlapping amount d of the tooth rows in accordance with the thickness of the recording medium batch 42. When the thickness of the recording medium batch 42 is small and the engagement overlapping amount d is large, the recording media pinched between the tooth rows may be stretched and broken, and accordingly, the recording medium batch 42 is not necessarily able to be bound. Accordingly, when the thickness of the recording medium batch 42 is small, a small engagement overlapping amount d is appropriate. In contrast, when the thickness of the recording medium batch 42 is large and the engagement overlapping amount d is small, it may be impossible to sufficiently deform the recording media into a wave shape, and accordingly, the recording media are not necessarily combined with one another and it may be impossible to bind the recording medium batch 42. Accordingly, when the thickness of the recording medium batch 42 is large, a large engagement overlapping amount d is appropriate.

In this recording-medium binding device 10, in order to address recording medium batches 42 of different thicknesses, the lower tooth row 40 of the lower tooth form 36 includes the teeth of different tooth heights. Teeth (low teeth) 46 having a small tooth height hs are arranged at a central portion of the lower tooth row 40. Teeth (high teeth) 48 having a large tooth height ht are arranged beside both sides of the low teeth 46 (hs<ht). The upper tooth row 38 of the upper tooth form 34 includes teeth 50 that are uniform in tooth height. The tooth height of the teeth 50 of the upper tooth row 38 is able to be the tooth height ht of the high teeth 48 of the lower tooth row 40. Hereafter, the low teeth 46 of the lower tooth row 40 are referred to as "lower low teeth 46", the high teeth 48 of the lower tooth row 40 are referred to as "lower high teeth 48", and the teeth of the upper tooth row 38 are referred to as "upper high teeth 50". The engagement overlapping amount d of a combination of the lower low teeth 46 and the upper high teeth 50 is small. This combination corresponds to the recording medium batch 42 having a small thickness. In contrast, the engagement overlapping amount d of a combination of the lower high teeth 48 and the upper high teeth 50 is large. This combination corresponds to the recording medium batch 42 having a large thickness. The above-described types of teeth are uniform in width.

In each of the upper tooth row 38 and the lower tooth row 40, tooth bottoms are aligned in the tooth height direction. Since the teeth of the upper tooth row 38 are uniform in tooth height, the tops of the teeth of the upper tooth row 38 are also aligned in the tooth height direction. In contrast, in the tooth height direction, the position of the tooth tops of the lower high teeth 48 projects toward the upper tooth row 38 more than the position of the tooth tops of the lower low teeth 46 in the lower tooth row 40. Accordingly, when binding the recording medium batch 42, the lower high teeth 48 and the upper high teeth 50 are first brought into contact with and pinch the recording medium batch 42. After that, the lower low teeth 46 and the upper high teeth 50 are brought into contact with and pinch the recording medium batch 42. As described above, with the recording-medium binding device 10, the recording medium batch 42 is first pinched in end regions 54 in which the lower high teeth 48 are disposed, and then the recording medium batch 42 is pinched in a central region 52 in which the lower low teeth 46 are disposed.

Figure 4:
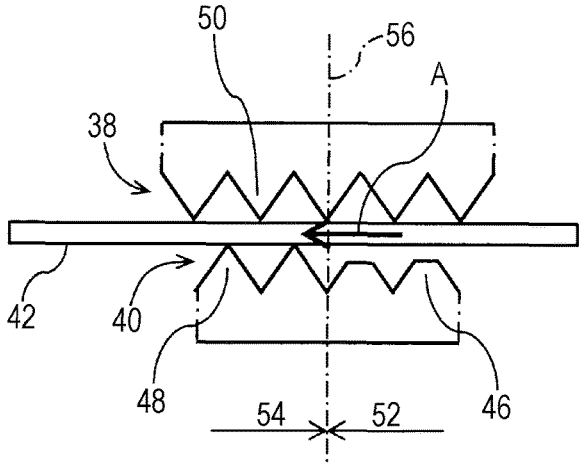
FIG. 4 illustrates a movement of a recording medium batch near a boundary between a low tooth region and a high tooth region.

FIG. 4 illustrates a state in which the tooth tops of the upper tooth row 38 and the lower tooth row 40 abut the recording medium batch 42. When an engaged state is advanced from this state, part of the recording media in each of the end regions 54 is pressed and stretched by the tooth rows 38 and 40 and deformed. At this time, near a boundary 56 between the end region 54 and the central region 52, a force acts on the recording medium batch 42 so that the part of the recording medium batch 42 in the end region 54 pulls the part of the recording medium batch 42 in the central region 52 into the end region 54 (see arrow A). Referring to FIG. 4, when the right side of the recording medium batch 42 is not restrained, the recording medium batch 42 is pulled from a position farther from the center in the tooth arrangement direction than the tooth rows 38 and 40. The amount of the recording medium batch 42 pulled at this time is not stabilized but varied due to states of the circumstance, properties of the recording media, and so forth. As opposed to an example illustrated in FIG. 2, when high teeth are provided at the central portion and low teeth are provided at the end portions, the recording medium batch 42 is first pinched at the center. Then, as a binding process is advanced, the recording medium batch 42 is pulled from positions farther from the center in the tooth arrangement direction than the tooth rows 38 and 40 into the end regions 54 where the low teeth are disposed. Accordingly, the length of the recording media contributing to binding of the recording medium batch 42 varies in the end regions 54.

In the case where the recording medium batch 42 is first pinched by the teeth in the end regions 54 on both the sides as illustrated in FIG. 2, the force acts on the recording medium batch 42 so that the tooth rows in the respective end regions 54 pull in the recording medium batch 42 as indicated by arrows B. However, since the recording medium batch 42 is pulled from both the sides, the actual amount of pulling is small. Furthermore, since both the sides of the recording medium batch 42 is pinched and restrained, feed of the recording medium batch 42 from outside of the tooth rows 38 and 40 toward the central region 52 is suppressed. Thus, variation of the length of the recording media contributing to binding of the recording medium batch 42 may decrease, and accordingly, a stretching amount of the recording media may be stabilized.

Furthermore, binding the recording medium batch 42 with tooth rows having aligned tooth tops makes the binding process simultaneously advance throughout the tooth rows. This increases deformation of the entirety of the recording media, and the amount of the recording medium batch 42 pulled from outside the tooth rows increases correspondingly. Thus, variation of the length of the recording media contributing to the binding increases. With the example illustrated in FIG. 2, the recording medium batch 42 restrained by both the end portions of each of the tooth rows 38 and 40 is deformed at the central portion. This suppresses pulling of the recording medium batch 42 from outside the tooth rows 38 and 40 (see arrows C) due to the deformation at the central portion. Thus, variation of the length of the recording media contributing to binding may be suppressed, and accordingly, a stretching amount of the recording media may be stabilized.

Teeth having a different tooth height are provided only in the lower tooth form 36. Thus, processing of the tooth tops for decreasing the tooth height is not required for the upper tooth form 34, and accordingly, the number of steps is decreased. This may facilitate fabrication.

Figure 5:
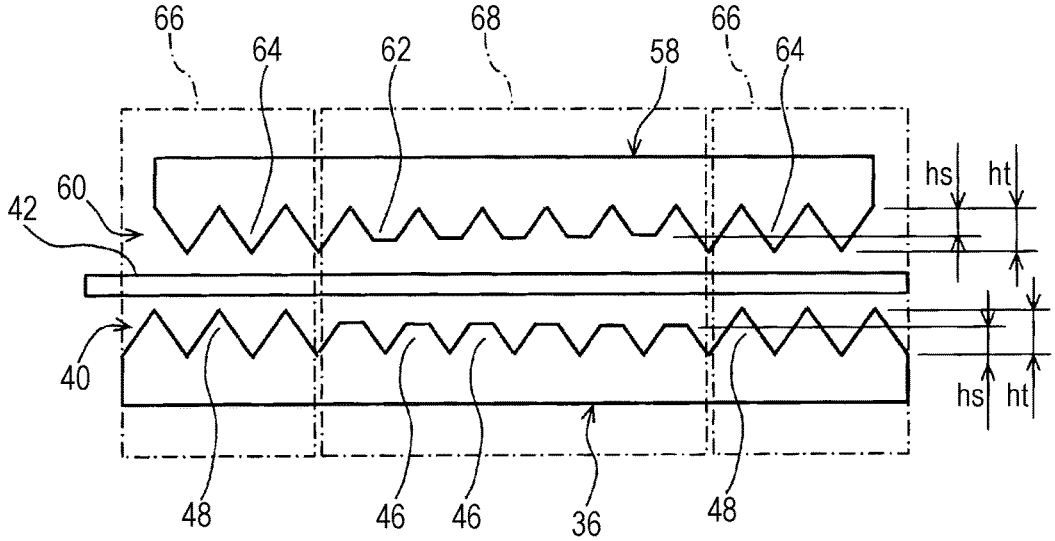
FIG. 5 illustrates another example of tooth rows of the recording-medium binding device.

FIG. 5 illustrates another example of an upper tooth form. A lower tooth form is the same as the lower tooth form 36. Accordingly, in the following description, elements included in the lower tooth form 36 are denoted by the same reference numerals as those in the above description. In this example, as is the case with the lower tooth row 40, in an upper tooth row 60 of an upper tooth form 58, teeth (upper low teeth) 62 having a small tooth height hs are arranged at the center and teeth (upper high teeth) 64 having a large tooth height ht are arranged in both end portions. Also in this example, in the process of binding the recording medium batch 42, the recording medium batch 42 is pinched earlier in end regions 66 where the high teeth 48 and 64 face one another than in a central region 68 where the low teeth 46 and 62 face one another. With this example, pinching of the recording medium batch 42 in the end regions 66 may precede more reliably than with the case where the teeth of different tooth heights are provided only in one of the tooth rows.

Although the position of the tooth top in the tooth height direction is varied by varying the tooth height according to the above-described exemplary embodiment, this is not limiting. The position of the tooth top may be varied by another technique. For example, the position of the tooth top may be varied by varying the position of the tooth bottom without varying the tooth height.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A recording-medium binding device comprising:

a first tooth row that includes a plurality of teeth arranged in a tooth arrangement direction; and a second tooth row that includes a plurality of teeth arranged in the tooth arrangement direction, wherein the second tooth row is configured to be engaged with the first tooth row, wherein the second tooth row is configured to cooperate with the first tooth row to pinch a recording medium batch so as to bind recording media, wherein the first tooth row and the second tooth row include a central region having sides and end regions disposed beside the respective sides of the central region in the tooth arrangement direction, wherein the plurality of teeth of the first tooth row include at least one tooth disposed in the central region and at least one tooth disposed in one of the end regions, wherein the plurality of teeth of the second tooth row include at least one tooth disposed in the central region and at least one tooth disposed in one of the end regions, and wherein the at least one tooth of the first tooth row in one of the end regions and the at least one tooth of the second tooth row in the one of the end regions are configured to pinch the recording medium batch earlier than the at least one tooth of the first tooth row in the central region and the at least one tooth of the second tooth row in the central region.

2. The recording-medium binding device according to claim 1, wherein, in the first tooth row, a tooth top of the at least one tooth in one of the end regions projects more than a tooth top of the at least one tooth in the central region, and wherein, in the second tooth row, tooth tops of the plurality of teeth are aligned with one another.

3. The recording-medium binding device according to claim 1, wherein, in the first tooth row, a tooth top of the at least one tooth in one of the end regions projects more than a tooth top of the at least one tooth in the central region, and wherein, in the second tooth row, a tooth top of the at least one tooth in one of the end regions projects more than a tooth top of the at least one tooth in the central region.

4. A recording-medium binding device comprising:

a first tooth row that includes a plurality of teeth arranged in a tooth arrangement direction; and a second tooth row that includes a plurality of teeth arranged in the tooth arrangement direction, wherein the second tooth row is configured to be engaged with the first tooth row, wherein the second tooth row is configured to cooperate with the first tooth row to pinch a recording medium batch so as to bind recording media, wherein the first tooth row and the second tooth row include a central region having sides and end regions disposed beside the respective sides of the central region in the tooth arrangement direction, wherein the plurality of teeth of the first tooth row include at least one tooth disposed in the central region and at least one tooth disposed in one of the end regions, wherein the plurality of teeth of the second tooth row include at least one tooth disposed in the central region and at least one tooth disposed in one of the end regions, wherein, out of the plurality of teeth in the first tooth row, a tooth top of the at least one tooth in one of the end regions projects more than a tooth top of the at least one tooth in the central region, and wherein, in the second tooth row, tooth tops of the plurality of teeth are aligned with one another, or, out of the plurality of teeth in the second tooth row, a tooth top of the at least one tooth in one of the end regions projects more than a tooth top of the at least one tooth in the central region.

5. A recording-medium binding device comprising:

a first tooth row that includes a plurality of teeth arranged in a tooth arrangement direction; and a second tooth row that includes a plurality of teeth arranged in the tooth arrangement direction, wherein the second tooth row is configured to be engaged with the first tooth row, wherein the second tooth row is configured to cooperate with the first tooth row to pinch a recording medium batch so as to bind recording media, wherein the first tooth row and the second tooth row include a central region having sides and end regions disposed beside the respective sides of the central region in the tooth arrangement direction, wherein the plurality of teeth of the first tooth row include at least one tooth disposed in the central region and at least one tooth disposed in one of the end regions, wherein the plurality of teeth of the second tooth row include at least one tooth disposed in the central region and at least one tooth disposed in one of the end regions, and wherein the at least one tooth of the first tooth row in one of the end regions and the at least one tooth of the second tooth row in one of the end regions project more than the at least one tooth of the first tooth row disposed in the central region and the at least one tooth of the second tooth row disposed in the central region.

* * * * *